US007892069B2

(12) United States Patent
Na et al.

(10) Patent No.: US 7,892,069 B2
(45) Date of Patent: Feb. 22, 2011

(54) LOADING DEVICE OF CHEMICAL MECHANICAL POLISHING EQUIPMENT FOR SEMICONDUCTOR WAFERS

(75) Inventors: Young Min Na, Seoul (KR); Chang Il Kim, Seoul (KR); Young Su Heo, Ansan (KR)

(73) Assignee: K.C. Tech Co., Ltd., Ansong-shi, Kyonggi-do (KR)

( * ) Notice: Subject to any disclaimer, the term of this patent is extended or adjusted under 35 U.S.C. 154(b) by 519 days.

(21) Appl. No.: 12/088,751

(22) PCT Filed: Jul. 21, 2006

(86) PCT No.: PCT/KR2006/002893

§ 371 (c)(1),
(2), (4) Date: Mar. 31, 2008

(87) PCT Pub. No.: WO2007/061170

PCT Pub. Date: May 31, 2007

(65) Prior Publication Data

US 2009/0130955 A1 May 21, 2009

(30) Foreign Application Priority Data

Nov. 25, 2005 (KR) ..... 10-2005-0113216

(51) Int. Cl.
*B24B 49/00* (2006.01)

(52) U.S. Cl. ..... 451/6; 451/460

(58) Field of Classification Search ..... 451/5, 451/6, 8, 11, 41, 285–290
See application file for complete search history.

(56) References Cited

U.S. PATENT DOCUMENTS

| | | | | |
|---|---|---|---|---|
| 6,059,636 | A * | 5/2000 | Inaba et al. | 451/5 |
| 6,132,289 | A * | 10/2000 | Labunsky et al. | 451/6 |
| 6,354,914 | B1 * | 3/2002 | Inaba et al. | 451/41 |
| 6,937,915 | B1 * | 8/2005 | Kistler et al. | 700/121 |
| 2004/0127142 | A1 * | 7/2004 | Olgado | 451/5 |
| 2005/0176349 | A1 * | 8/2005 | Yilmaz et al. | 451/8 |
| 2010/0112901 | A1 * | 5/2010 | Togawa et al. | 451/5 |

FOREIGN PATENT DOCUMENTS

| | | |
|---|---|---|
| KR | 2004-0083845 A | 10/2004 |
| KR | 2004-0092740 A | 11/2004 |

* cited by examiner

*Primary Examiner*—Maurina Rachuba
(74) *Attorney, Agent, or Firm*—Leydig, Voit & Mayer, Ltd.

(57) ABSTRACT

A loading device of chemical mechanical polishing (CMP) equipment for processing semiconductor wafers is provided. The loading device includes a loading cup having a cup-like bath, a cup plate installed in the bath, and a loading plate supported on the cup plate for absorbing shock and seating the wafer. A driving device and a driving shaft horizontally pivot and vertically move the loading cup between a platen of a polishing apparatus and a spindle. An arm connects the loading cup and the driving shaft. At least one through hole is located in a mutually corresponding position of the bath, the cup plate, and the loading plate of the loading cup. A probe assembly optically detects a polished thickness at a polished point on the wafer.

7 Claims, 3 Drawing Sheets

[Fig. 1]
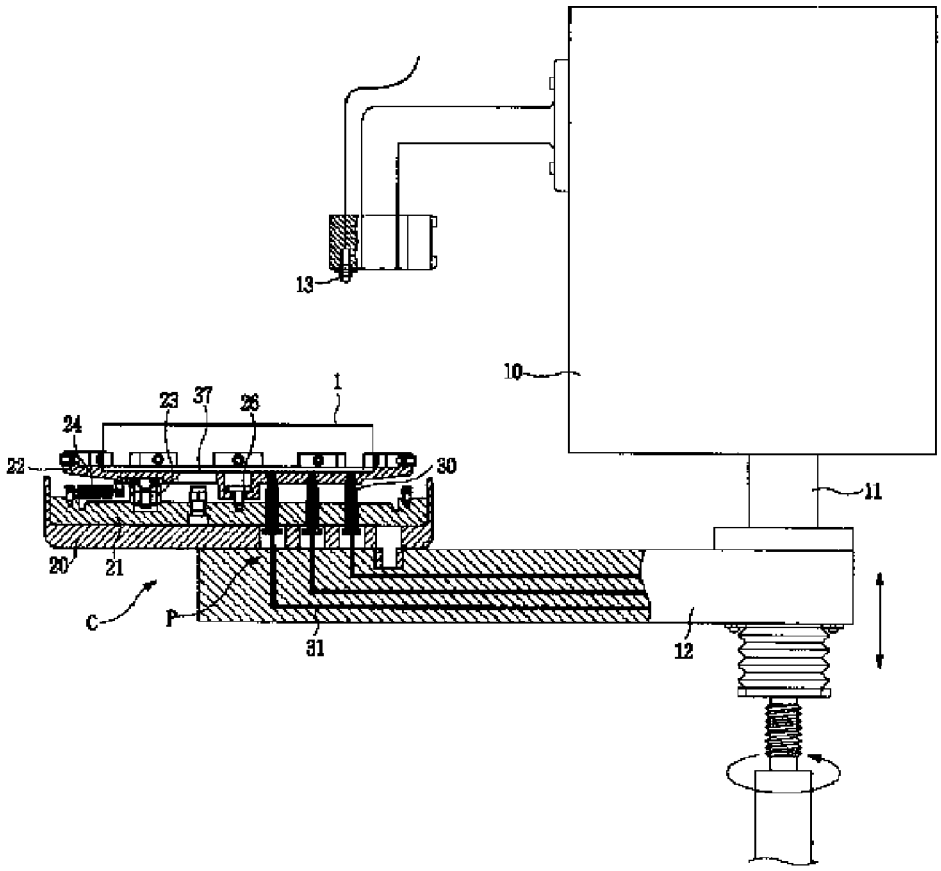
[Fig. 2]
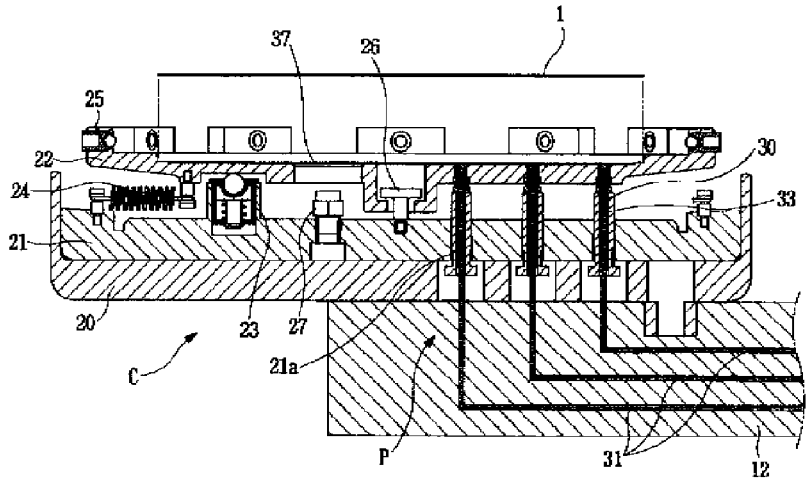

[Fig. 3]
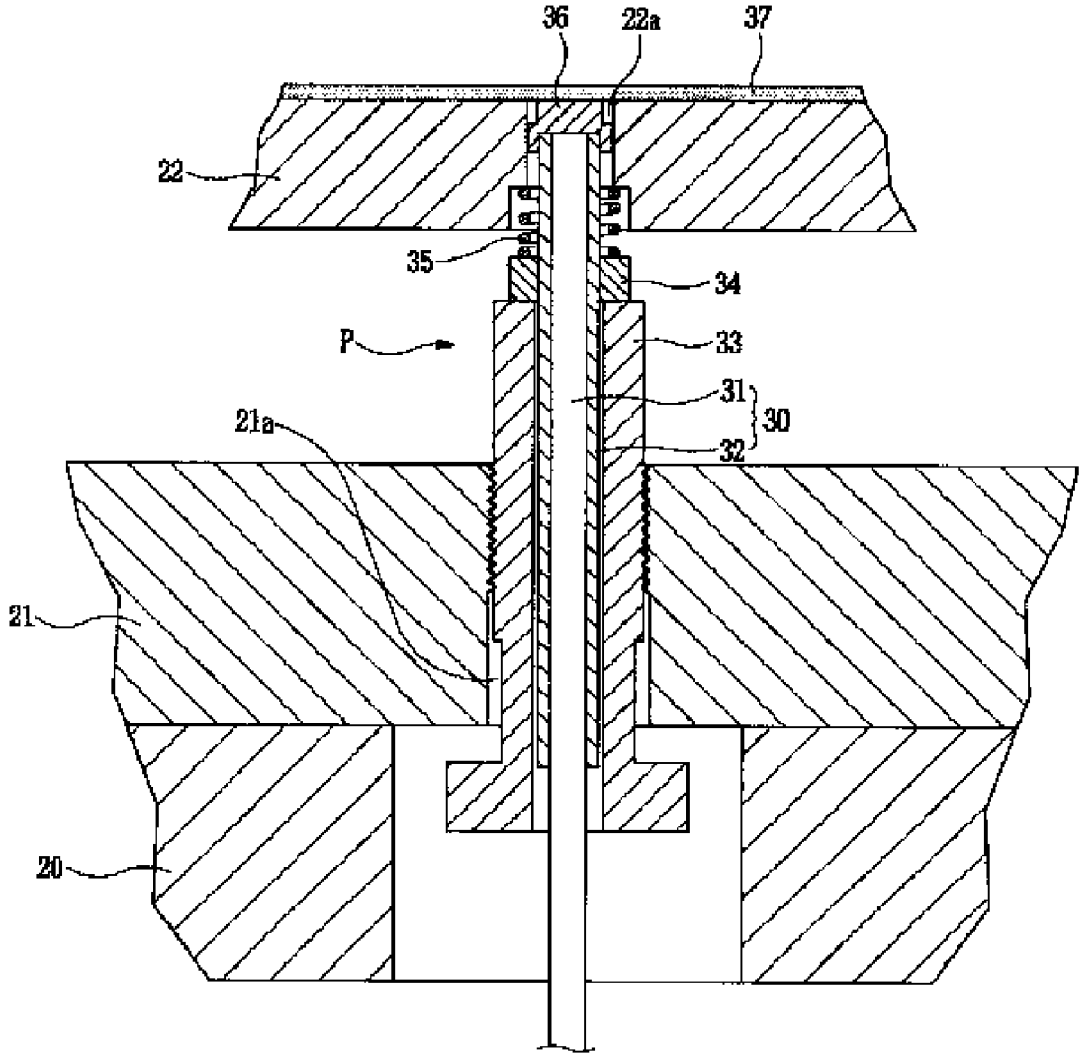

[Fig. 4]
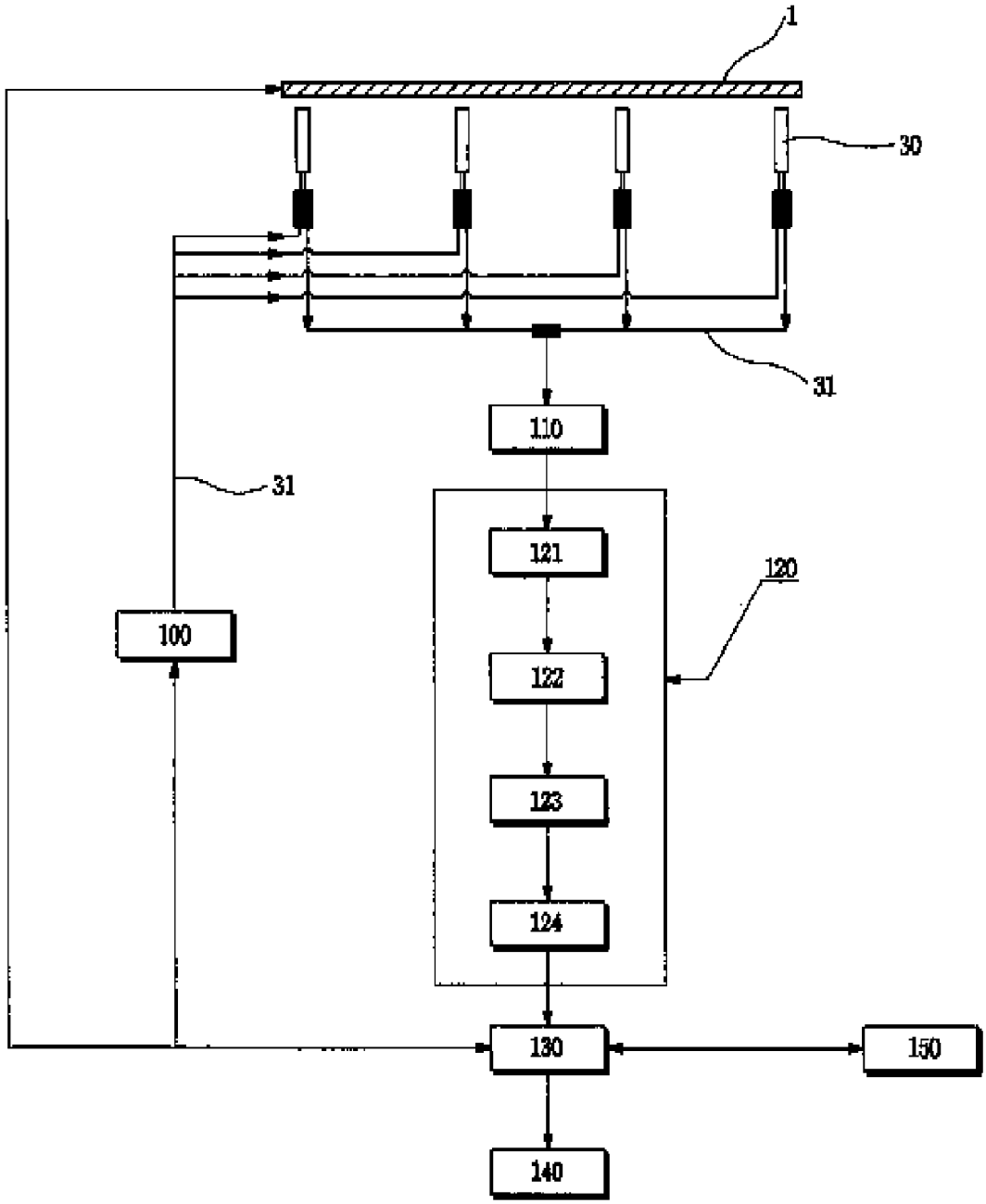

LOADING DEVICE OF CHEMICAL MECHANICAL POLISHING EQUIPMENT FOR SEMICONDUCTOR WAFERS

TECHNICAL FIELD

The present invention relates to a loading device of chemical mechanical polishing (CMP) equipment for semiconductor wafers, and more particularly, to a loading device of CMP equipment for semiconductor wafers in which the thickness of a layer on a wafer can be measured by at least one loading device installed in the CMP equipment for a single-step or multi-step polishing process, after a polishing process is performed on a previously input wafer and just before it is performed on a subsequently input wafer, or before a subsequent polishing process is performed on the same previously input wafer, Accordingly, information useful for polishing the subsequent wafer can be more rapidly delivered and reflected, thereby enhancing wafer polishing precision as well as simplifying a structure of the CMP equipment.

BACKGROUND ART

In general, Chemical Mechanical Polishing (CMP) equipment is important semiconductor equipment employed to polish the surface of a wafer. CMP equipment is generally comprised of a polishing apparatus and a loading device. The polishing apparatus includes a platen on which a polishing pad is attached, a slurry supply that supplies a slurry for chemical polishing to the polishing pad, a spindle which grasps and rotates the wafer in contact with the polishing pad by means of a polishing carrier located above the polishing pad, thereby physically polishing the wafer, and so on. The loading device delivers the wafer, which is transferred from a wafer cassette by a robot arm, to a head of the polishing carrier so as to be able to load/unload the wafer on/from the polishing carrier head.

In the semiconductor process, it is important to control any process, for instance a polishing process of a processing target such as a wafer by monitoring its progress in real time and terminating it at a proper point of time, which is called detection of a process end point or a polishing end point. There is a device which is adapted to detect this polishing end point and transmit a signal to a process module controller to complete the process. This device is called an end point detector (EPD).

In particular, in the case of a CMP process using CMP equipment, the polishing end point is detected by measuring the thickness of the wafer before and after polishing. To this end, an in-line metrological thickness measurement technique using an optical system is typically applied. The polishing end point in a semiconductor wafer surface polishing process based on the in-line metrological thickness measurement technique can be detected by emitting light from a light source, reflecting the light on the surface of the wafer before and after polishing, and allowing a photo-detector (or a probe assembly) to receive the reflected light and measure change in interference of the received light. In this manner, information on a removal rate can be obtained and applied when a subsequent wafer is polished, thus enabling more precise polishing control.

This wafer polishing process may entail polishing only one wafer at a time, transferred by the loading device on a single platen. But, in most cases, the process entails sequentially polishing a plurality of wafers transferred by a plurality of loading devices, installed around the polishing apparatus, on a plurality of platens arranged adjacent to each other, which is called a multi-step polishing process.

Concrete examples of conventional methods and apparatuses for detecting the polishing end point by employing the optical thickness measurement technique of the semiconductor wafer described above are disclosed in Korean Patent Application Nos. 10-2003-0018522 and 10-2003-0027043, filed by the present applicant.

Korean Patent Application No. 10-2003-0018522 discloses technology for detecting change in a layer s thickness by using an interference phenomenon without depending on the intensity of reflected light as did previous technology, when the end point of a process of polishing a layer on a wafer to a predetermined thickness is detected by an optical system. Using this technology, the end point of the polishing process can be precisely detected.

Korean Patent Application No. 10-2003-0027043 discloses a technical configuration in which a probe assembly is installed in a platen of CMP equipment so that a tip of the probe assembly can approach the surface of a wafer in order to allow polishing information to be recognized in real time while the surface of the wafer is polished.

According to the concrete embodiments disclosed in the specifications of these prior patent applications, a transmission window is formed by boring a hole in a polishing pad and covering it with a light-transmission protective cap, light is directly applied onto a wafer through the transmission window, and a change in layer thickness is detected based on change in a property of the reflected light. In other words, the conventional technology detects the polishing end point as a point of time when a unique change is detected in a process of performing multi-step correction on digital data obtained through an optical sensor (probe), and stops the polishing process at the point of time.

In the conventional art described above, the probe assembly for detecting the light is mounted in the platen of the polishing equipment, the polishing process is performed, change in thickness of the layer being polished can be simultaneously tracked in real time, and thereby the polishing end point can be detected. Here, the light is applied at designated locations on the wafer, and waveform signals of the reflected light according to the layer thickness of the wafer are analyzed to obtain the thickness information. Here, the polishing end point can be instructed by a command system stopping the polishing process at a specified peak or valley of the waveform of the reflected light.

However, the conventional method and apparatus for detecting the end point have the following problems.

First, because the surface (pattern surface) of the wafer is polished chemically and mechanically by the CMP equipment, a large quantity of noise and unnecessary data are mixed in with the data obtained by detecting the surface of the wafer. Thus, compared to previous methods, it is necessary to process a large volume of complicated data. According to a pattern type, end point detection precision may be lowered.

Second, in the structure where the transmission window is formed on the polishing pad, change in reflection characteristics (distortion phenomenon) such as refraction is caused by water or slurry existing between the wafer and the tip of the probe during the surface polishing process. Also, transmission and reflection performance may be lowered by damage to the surface of the transmission window while the transmission window (light-transmission protective cap) formed on the polishing pad causes physical friction with the polishing carrier and conditioner. As a result, the end point detection precision can be lowered. Moreover, the surface of the wafer may be scratched or unevenly polished by the transmission window, thereby causing defects and reducing the lifespan of the polishing pad.

Third, an error may occur in the measurement for detecting the end point, because the light transmittance ratio varies depending on distance between the wafer and the probe or a surface state of the probe protector (light-transmission protective cap) covering its end so as to protect the probe. In order to compensate for this measurement error, a separate automatic gain control (AGC) process is required, which makes the whole polishing processes complicated.

Fourth, as both the wafer and the probe assembly are rotated in the wafer surface polishing process should first be synchronized. This may pose an obstacle to simple and convenient equipment operation.

Meanwhile, the wafer controlled to be polished up to a specified polishing end point by the above-described end point detecting method and apparatus is transferred into a wafer station installed at one side of the polishing apparatus before and after polishing. It is measured whether a pre-polishing state of the layer of the wafer is normal, or whether the layer of the wafer is polished to a desired proper thickness, thus testing for processing defects on the wafer. Here, a thickness measurement detection technique is employed. In the case of a continuous single-step polishing process of numerous wafers, the thickness measurement detection technique is for extracting polishing information about a previously input wafer to provide information that can be reflected in a polishing process of a subsequently input wafer. And, in the case of a multi-step polishing process of a single wafer, the thickness measurement detection technique is for extracting polishing information about an input wafer to provide information that can be reflected in a subsequent polishing process of the wafer. An optical in-line metrological thickness measurement detection apparatus similar to the end point detection apparatus is used to perform the thickness measurement detection technique.

More specifically, the conventional in-line metrological wafer layer thickness measurement technique is carried out in a wafer station of the polishing equipment, and generally performed on the wafer before beginning a polishing process or after completing polishing and cleaning processes. Light is applied at numerous designated locations on the wafer, and correlation between the waveform signal of the reflected light and the layer thickness of the wafer is analyzed and converted into information, so that information on the layer thickness can be obtained. Thus, it can be determined whether or not the processed wafer has been polished normally.

However, due to characteristics of the method and apparatus, the conventional in-line metrological wafer layer thickness measurement technique can only obtain information related to removal rate, such as information on layer thickness, after all polishing processes of the previously input wafer have been completed. Hence, there is a corresponding delay in obtaining the information about the polishing processes, and consequently, it is inevitable that the value and availability of the obtained information are correspondingly lowered. Also, the layer thickness of the wafer can only be measured in a separate wafer station for measuring the layer thickness after the wafer is transferred up to a position of the optical system, so that the overall polishing process is delayed. Further, the wafer station increases the size of the equipment, and thus the arrangement and space utilization are lowered.

DISCLOSURE OF INVENTION

Technical Problem

The present invention is directed to a loading device for chemical mechanical polishing (CMP) equipment for semiconductor wafers, in which in the process of performing a single-step or multi-step wafer surface polishing process for a constant time, a wafer is transferred by at least one loading device installed in a polishing apparatus for the single-step or multi-step wafer surface polishing process, and a polished level is immediately measured in the loading device separated from the wafer polishing process without surface damage. This makes it possible to maintain a constant transmittance ratio to precisely detect change in layer thickness with negligible measurement error, eliminate a compensating process based on a separate automatic gain control (AGC) process, simplify data processing and an overall polishing process, and reduce the size of the CMP equipment. Moreover, this makes it possible to immediately obtain, by more rapidly transmitting and reflecting measurements, information useful for a subsequent polishing process of the wafer during the multi-step polishing process, and thus remarkably reduces a time taken to measure change in layer thickness of the wafer.

Technical Solution

One aspect of the present invention provides a loading device of chemical mechanical polishing (CMP) equipment for semiconductor wafers, including a loading cup having a cup-like bath, a cup plate installed in the bath, and a loading plate supported on the cup plate so as to be capable of absorbing shock and seating the wafer; a driving device and a driving shaft horizontally pivoting and vertically moving the loading cup between a platen of a polishing apparatus and a spindle; and an arm connecting between the loading cup and the driving shaft. The loading device is characterized in that: at least one through hole is formed at one or more mutually corresponding positions of the bath and cup plate and the loading plate of the loading cup; at least one probe assembly for optically detecting a polished thickness at a polished point on the wafer is inserted and installed into each through hole at the corresponding position of the loading cup; an optical thickness detection device capable of applying light onto a layer on the wafer to detect reflected spectrum wavelengths, and detecting a layer thickness of the wafer by change in a physical quantity extracted from a spectrum interference signal between the detected reflected spectrum wavelengths is provided at one side of the driving device; and an optical fiber cable connecting each of the probe assemblies and the thickness detection device is disposed in the arm.

Further, the probe assembly may include an optical fiber cable connected with the light source of the thickness detection device, a ferrule surrounding the optical fiber cable, a light-transmission protective cap as a transmission window coupled to tips of the optical fiber cable and the ferrule inserted into the loading plate at a through hole, and a probe tip positioner for finely positioning tips of the optical fiber cable and the light-transmission protective cap in a vertical direction.

Also, the probe tip positioner may include an insert ring that is closely fixed to an outer surface of the ferrule near the back surface of the loading plate, a compressible resilient body that is interposed and supported at both ends between a step in the through hole of the loading plate and a top surface of the insert ring and continuously exerts resilient force tending to simultaneously lower the insert ring together with the optical fiber cable and the ferrule, and a positioning threaded pipe that has the shape of a pipe, is formed with a through hole in its longitudinal direction so as to be able to receive the optical fiber cable and the ferrule without contact, is formed with a male thread on its outer surface so as to be received in a through hole of the cup plate and screwed into a female thread formed in the through hole of the cup plate, and contacts and upwardly supports a back surface of the insert ring at its top end.

Besides, a light-transmission protective layer may be further formed on a top surface of the loading plate of the loading cup to protect a probe from contamination caused by slurry remnants during a polishing process and precisely detect reflected light.

In addition, the polishing apparatus may include at least one pair of a polishing carrier and a platen which can perform multi-step polishing on the layer formed on one wafer once or more, and can extract information on the layer thickness of at least one wafer disposed between the polishing carrier and the platen after a polishing process is performed on a previously input wafer and just before it is performed on a subsequently input wafer, or before a subsequent polishing process is performed on the same previously input wafer.

Advantageous Effects

A loading device in accordance with the present invention is capable of precisely detecting change in thickness of a layer on a wafer with negligible measurement error by maintaining a constant transmittance ratio regardless of pattern. This can be accomplished by transferring the wafer using at least one loading device installed in single-step or multi-step wafer surface polishing equipment, and immediately measuring the polished level in the loading device separated from the wafer surface polishing process through a transparent window without a surface damage, during a process of polishing the wafer in a single-step or multi-step manner by a predetermined program for a certain time.

In addition, since a separate wafer layer thickness measurement can be performed, there is no need of a compensation process by a separate AGC. Further, since it is possible to obtain effective data from which noise is remarkably removed, data processing and the overall polishing process can be simplified.

Furthermore, since there is no need of synchronization between the wafer and a photodetector, the equipment can be conveniently operated. Especially, since useful information for the following wafer polishing process can be instantly obtained, rapidly transmitted and applied, even during a multi-step polishing process, time consumed in measuring layer thickness variation can be remarkably reduced.

In addition, it is possible to simplify the equipment and improve spatial arrangement and space utilization by implementing a predetermined structure in the conventional loading device, without installing of a separate wafer station for measuring the wafer layer thickness.

BRIEF DESCRIPTION OF THE DRAWINGS

FIG. 1 schematically illustrates a structure of a loading device of chemical mechanical polishing (CMP) equipment for semiconductor wafers according to the present invention;

FIG. 2 is a longitudinal sectional view illustrating a structure of a loading cup in which a probe assembly according to the present invention is mounted;

FIG. 3 is a partially magnified sectional view illustrating a detailed structure of a probe assembly P applied to a loading cup C of the present invention; and FIG. 4 is a block diagram illustrating components of a thickness detection device applied to the present invention.

MODE FOR THE INVENTION

Hereinafter, exemplary embodiments of the present invention will be described in detail. However, the present invention is not limited to the exemplary embodiments disclosed below, but can be implemented in various types. Therefore, the present exemplary embodiments are provided for complete disclosure of the present invention and to fully inform the scope of the present invention to those of ordinary skill in the art.

FIGS. 1 to 4 illustrate a construction of a wafer layer thickness detecting system applied to chemical-mechanical polishing (CMP) equipment for semiconductor wafers according to the present invention. FIG. 1 schematically illustrates a structure of a loading device of CMP equipment for semiconductor wafers according to the present invention. FIG. 2 is a longitudinal sectional view illustrating a structure of a loading cup C in which a probe assembly P according to the present invention is mounted. FIG. 3 is a partially magnified sectional view illustrating a detailed structure of a probe assembly P applied to a loading cup C of the present invention. FIG. 4 is a block diagram illustrating components of a thickness detection device applied to the present invention.

It should be noted that the present invention can be broadly applied to processes where various types of layers such as an insulating layer, conductive layer, semiconductive layer, silicon layer, gallium layer, oxide layer, tungsten layer, aluminum layer and the like are formed on the surface of a wafer.

Further, since the present invention applies the conventional in-line metrological measurement technique, as in a typical end point technique it is impossible to measure change in thickness of a layer on a wafer in real time during polishing. However, the present invention is adapted to rapidly extract information on absolute numerical values of the layer thickness of a wafer that is previously input and then polished on the side of a loading device, and reflect the extracted information in a subsequent polishing process of the wafer or a polishing process of a subsequently input wafer, thereby making it possible to improve polishing precision. In other words, the present invention is adapted to apply the existing in-line metrological thickness measurement technique using an optical system and has a structure in which an optical thickness detection device including a light source 100 and a photodetector (probe assembly) P is disposed on the lower portion of a loading cup C, so that when the wafer 1 is transferred for a subsequent polishing process before or after a single-step polishing process or during a multi-step polishing process, the thickness of the wafer 1 can be rapidly and precisely measured while the wafer 1 is loaded or unloaded. Here, it is natural that multiple wavelengths of light from the light source 100 are used to measure a change in interference of the light at many positions on the wafer surface by means of a spectrometer, and that a process module controller (central processing unit (CPU)) 130 is connected to an optical system (spectrum intensity data detection device) 120 so as to be able to control a removal rate, a process end point, etc., according to change in the thickness of the wafer 1.

Thus, the loading device for polishing equipment according to the present invention can be considered to provide a new construction that is intended to determine how precisely a desired thickness is obtained by the wafer polishing method of the preceding step, and then if the wafer polishing method of the preceding step is determined to be ideal, to reflect data from the ideal method in a wafer polishing method for a polishing process of a subsequently input wafer or a subsequent polishing process of the same previously input wafer.

As illustrated in FIGS. 1 and 2, the loading device of CMP equipment for semiconductor wafers according to the present invention, which applies the general optical thickness measurement technique as described above, is comprised of the loading cup C on which the wafer 1 is seated, a driving device 10 and a driving shaft 11 horizontally pivoting and vertically moving the loading cup C between a platen of a polishing apparatus and a polishing carrier head (not shown) of a spindle, and an arm 12 connecting between the loading cup C and the driving shaft 11.

Typically, the driving device 10 above the loading cup C can be equipped with a wafer detection sensor 13 at one side thereof, which is capable of detecting whether or not the wafer 1 is seated on the loading cup C. A cleaning solution supply (not shown) is disposed through the arm 12 and connected with a pure water nozzle 27 mounted in the loading cup C.

The loading cup C is constructed in such a manner that a cup plate 21 is installed in a cup-like bath 20, a loading plate 22 capable of seating the wafer 1 is placed on the cup plate 21, and a plurality of vertical shock-absorbers 23 and horizontal shock-absorbers 24 are interposed between the cup plate 21 and the loading plate 22, wherein the plurality of vertical shock-absorbers 23 allow the loading plate 22 to tilt and sink, and the plurality of horizontal shock-absorbers 24 actively correct a position of the loading plate 22 to a position of the polishing carrier head by allowing the loading plate 22 to roll about its normal axis, thereby centering the loading plate 22 in a normal state.

Here, each of the vertical shock-absorbers 23 is a means for tilting the wafer so that the wafer 1 can be in stable contact with a back surface of the polishing carrier head and a top surface of the loading plate 22 when supporting a back surface of the loading plate 22 to vacuum-chuck the wafer 1 seated on the loading plate 22 onto the polishing carrier head, or when unloading the wafer 1 vacuum-chucked on the polishing carrier head onto the loading plate 22. The horizontal shock-absorbers 24 are disposed at the back surface of the loading plate with radial symmetry and pointing toward the center of the loading plate 22, and are fixed at opposite ends to the cup plate 21 and the loading plate 22. Thus, the horizontal shock-absorbers 24 serve as a means enabling the wafer to be chucked/dechucked when it is loaded or unloaded between the polishing carrier head mounted to the spindle and the loading plate 22 and the loading plate 22 slightly rolls about its central axis within a predetermined driving error according to a positional deviation between the polishing carrier head and the loading plate 22, by restoring the polishing carrier head and the loading plate 22 to their normal position.

An edge of the loading plate 22 inscribed in a retainer ring (not shown) mounted around the outside of the polishing carrier head is so constructed that a plurality of guide rollers 25 protrude inward toward the center at equal intervals around the circumference of the loading plate 22. This structure is for minimizing friction caused by contact between the retainer ring and the loading plate 22. The loading plate 22 is provided at a predetermined position with at least one stopper hole (its reference numeral is not denoted) formed as a through hole with origin symmetry. The stopper hole is provided with a stopper 26 fastened therethrough with a predetermined clearance width so as to be able to prevent the loading plate 22 from escaping from the cup plate 21 and the bath 20.

The loading plate 22 of the loading cup C can be formed to have a light-transmission protective layer 37 formed of a transparent or semitransparent material capable of transmitting light on an upper surface thereof. The material can be selected from vinyl chloride, polyvinyl chloride (PVC), and urethane. In this manner, when the light-transmission protective layer 37 is formed on the loading plate 22, it is possible not only to protect a probe 30 from contamination from slurry remnants, but also to further improve detection precision of reflected light.

Meanwhile, as illustrated in FIG. 3, the probe assembly P is comprised of an optical fiber cable 31 connected with the light source 100 (FIG. 4) such as a white light source, a ferrule 32 surrounding the optical fiber cable 31, a light-transmission protective cap 36 as a transmission window coupled to tips of the optical fiber cable 31 and the ferrule 32 which are inserted into a through hole 22*a* of the loading plate 22, and a probe tip positioner for finely positioning tips of the optical fiber cable 31 and the light-transmission protective cap 36 in a vertical direction.

Here, the ferrule 32 is a tubular body that is integrally brought into close contact with an outer surface of the optical fiber cable 31 to protect as well as firmly support an end of the optical fiber cable 31 inserted into the through hole 22*a* of the loading plate 22.

The light-transmission protective cap 36 closely contacts and covers the tip of the optical fiber cable 31 to seal and protect the tip of the optical fiber cable 31 coupled with the ferrule 32, and is a means for allowing the tip of the optical fiber cable 31 to be stably received in the through hole 22*a* of the loading plate 22. As in the light-transmission protective layer 37, the light-transmission protective cap 36 can be made of a flexible semitransparent material such as vinyl chloride, polyvinyl chloride (PVC), or urethane, having a relatively low hardness over the layer on the wafer 1.

Further, the probe tip positioner includes an insert ring 34 that is closely fixed to an outer surface of the ferrule 32 near the back surface of the loading plate 22, a compressible resilient body 35 that is interposed and supported at both ends between a step in the through hole 22*a* of the loading plate 22 and a top surface of the insert ring 34 and continuously exerts resilient force tending to simultaneously lower the insert ring 34 together with the probe 30, and a positioning threaded pipe 33 that has the shape of a pipe, is formed with a through hole in its longitudinal direction so as to be able to receive the optical fiber cable 31 and ferrule 32 without contact, formed with a male thread on its outer surface so as to be received in a through hole 21*a* of the cup plate 21 and screwed into a female thread formed in the through hole 21*a*, and contacts and upwardly supports a back surface of the insert ring 34 at an upper end thereof.

The compressible resilient body 35 generally includes, but is not limited to, a helical compressive spring. Any alternative means such as a rubber ring capable of exerting the same function as the helical compressive spring may also be applied.

The probe assembly P having the above-mentioned construction, according to the present invention, is adapted to finely adjust a level of the top surface of the light-transmission protective cap 36. In this case, when the light-transmission protective cap 36 is to be raised, the positioning threaded pipe 33 is turned in a forward direction (fastening direction) as high as desired. In contrast, when the light-transmission protective cap 36 is to be lowered, the positioning threaded pipe 33 is turned in a backward direction (unfastening direction) as high as desired. More specifically, when the positioning threaded pipe 33 rotates in the forward direction, the compressible resilient body 35 is compressed, and then the end of the compressible resilient body 35 forcibly pushes up the insert ring 34. Thereby, the force pushing up the insert ring 34 is transmitted to the ferrule 32 and the optical fiber cable 31 and thus raises the light-transmission protective cap 36. In contrast, when the positioning threaded pipe 33 rotates in the backward direction, the compressible resilient body 35 downwardly compresses the insert ring 34 with its resilient force in proportion to a distance by which the end of the positioning threaded pipe 33 is displaced downward. Thereby, the force downwardly compressing the insert ring 34 is transmitted to the ferrule 32 and the optical fiber cable 31 and thus lowers the light-transmission protective cap 36.

In applying the probe assembly P to the loading device, after forming a through hole at a position where the bath 20, the cup plate 21, and the loading plate 22, all of which constitute the loading cup C of the loading device, are aligned with each other, the probe assembly P has only to be assembled into the through hole. Thus, application of the probe assembly is very readily completed. When there is a need to position a tip of the probe 30, e.g., when a tip of the probe 30 and a surface of the wafer 1 come into contact with each other, a position of the light-transmission protective cap 36 can be finely adjusted by simply rotating a positioning threaded pipe 33 clockwise or counterclockwise to raise/lower the probe 30 without disassembly of the entire thickness detection device. For this reason, it is possible to rapidly and readily mange and maintain the apparatus.

Meanwhile, the wafer layer thickness variation detection process of the present invention generally includes measuring a reflection intensity of light through a spectrometer, and processing a reflection intensity signal through respective processes of measuring a reflection intensity at each wavelength, processing the measured results into data, analyzing the data throughout the entire waveband to calculate the layer thickness, and then measuring a wavelength value corresponding to a specified reference point such as a peak or valley of the reflected spectrum interference signal waveform.

As disclosed in the conventional art, FIG. 4 is a schematic block diagram illustrating components of a wafer layer thickness detection device applied to the present invention. As illustrated in FIG. 4, the wafer layer thickness detection device according to the present invention includes a light source 100 having a wide spectrum region, an optical fiber cable 31 extending from the light source so as to apply light from the light source 100 toward the through-hole 22*a* of the loading plate 22, a probe 30 formed at one end of the cable 31 and disposed adjacent to the through hole 22*a*, a light attenuator 110 connected to the probe 30 by a separate optical fiber cable 31 to attenuate the intensity of the light reflected from the surface of the wafer 1 to an appropriate intensity and transmit the reflected light such that no more than an allowable intensity can be applied, a spectrum intensity data detection device 120 for converting the reflected light into an electrical signal to extract a predetermined optical signal, a central process unit 130 for comparing and calculating the optical signal to detect thickness variation and controlling a polishing speed of the polishing apparatus (CMP equipment) on the basis of the detected data, an input device 140 for inputting initial conditions and predetermined data of the polishing process into the central process unit 130, and an external storage device 150 for storing data detected from the central process unit 130, a signal processing program, and so on.

The spectrum intensity data detection device 120 includes a spectrometer 121 for collecting the reflected light introduced through the probe 30 and attenuated by the light attenuator and converting the reflected light into an electrical optical signal, an A/D converter 122 for converting an analog optical signal transmitted from the spectrometer 121 into a digital optical signal, an interference signal compensator 123 for removing an intensity difference between different wavelengths of light with respect to the digital optical signals transmitted from the A/D converter 122 to compensate for intensity variation, and a noise signal remover 124 for removing noise from the intensity-compensated spectrum interference signal transmitted from the interference signal compensator to extract a intensity-compensated, noise-removed spectrum interference signal.

The light source 100 may be one selected from a xenon lamp, a halogen lamp, and a tungsten lamp, and the present embodiment employs the xenon lamp. In addition, the optical fiber cable 31 uses a cable containing an optical fiber having a diameter from about 100 m to about 1000 m, and the spectroscope 121 includes 2048 charge coupled devices (CCD) to convert 2048 analog values into digital values.

The input device 140 includes a keyboard, a mouse, and so on, and the external storage device 150 may be a hard disk drive, a floppy disk drive, a CD-ROM drive, and so on.

With the construction of the thickness detection device, when the wafer 1 transferred from the loading device is chucked by the polishing head of the polishing apparatus to be mounted on the polishing pad, the spindle of the polishing apparatus rotates to perform a wafer surface polishing process for a predetermined time according to a predetermined program. Then, the wafer 1 polished for the predetermined time is transferred by the loading device having a transparent window 22*a*, and the polishing level of the wafer 1 can be instantly measured in the loading cup C separated from the wafer polishing process without surface damage. That is, the light source 100 emits light along the optical fiber cable 31 and through the transparent window 22*a* and the light-transmission protective layer 37 of the loading plate 22 to be incident on the layer on the wafer 1 and reflected to the probe 30. The reflected interference signal light is transmitted through the optical fiber cable 31 for receiving the reflected light connected to the probe 30 to the light attenuator 110 to be attenuated to an appropriate intensity and introduced into the spectrometer 121. Then, the interference signal light split through the spectrometer 121 is converted into an electrical spectrum interference signal, and then passed through the A/D converter 122 to be converted into a digital spectrum interference signal. The spectrum interference signal is converted into the intensity compensation and noise removal spectrum interference signal through the interference signal compensator 123 and the noise signal remover 124, and then the spectrum interference signal is transmitted to the central process unit 130 to extract a wavelength value of a specified reference point of the waveform of the spectrum interference signal. In comparison with the wavelength values obtained in this process, thickness of the wafer layer before and after polishing can be measured, and the polishing information is transmitted to the polishing apparatus for polishing a subsequent wafer 1 or for a subsequent polishing process of the same wafer 1, thereby more rapidly and precisely performing the polishing process of the layer on the wafer.

The method of measuring a wafer layer thickness using the loading device in accordance with the present invention may be applied to any removal process such as an ion etching process, as well as the CMP process described above. Also, it will be appreciated that the method may be widely applied to detect a thickness variation in a layer forming process such as a chemical vapor deposition (CVD) process, or a sputtering process for forming a layer such as a metal electrode or an insulating layer.

As described above, the present invention employs at least one loading device installed in a polishing apparatus for a single-step or multi-step polishing process to extract wafer layer thickness information after a polishing process is performed on a previously input wafer and just before it is performed on a subsequently input wafer, or before performing a subsequent polishing process of the same previously input wafer. Therefore, when a polishing process is continuously performed, it is possible to rapidly transmit and apply useful information for polishing a subsequent wafer, in comparison with the conventional in-line metrological wafer thickness measurement technique, according to which a measurement device is installed in a separate wafer station to measure a layer thickness of the wafer before a polishing process or after completion of a polishing or cleaning process.

Therefore, the present invention is capable of solving the problems of the conventional end point detection device and the in-line metrological thickness measurement technique, thereby simplifying the apparatus, and rapidly and precisely measuring thickness before and after polishing of a wafer. This is accomplished by rapidly performing feedback of the thickness measurement to provide information for controlling various polishing parameters when a subsequently input wafer or a current wafer is polished. Especially, according to the rapid feedback, it is possible to improve reliability of the apparatus by more precisely detecting thickness variation of the layer of a subsequently input wafer, in comparison with in-situ end point detection and thickness measurement of a previously polished wafer performed in an unstable environment.

INDUSTRIAL APPLICABILITY

As can be seen from the foregoing, a loading device in accordance with the present invention is capable of precisely detecting change in thickness of a layer on a wafer with negligible measurement error by maintaining a constant transmittance ratio regardless of pattern. This can be accomplished by transferring the wafer using at least one loading device installed in single-step or multi-step wafer surface polishing equipment, and immediately measuring the polished level in the loading device separated from the wafer surface polishing process through a transparent window without a surface damage, during a process of polishing the wafer in a single-step or multi-step manner by a predetermined program for a certain time.

In addition, since a separate wafer layer thickness measurement can be performed, there is no need of a compensation process by a separate AGC. Further, since it is possible to obtain effective data from which noise is remarkably removed, data processing and the overall polishing process can be simplified.

Furthermore, since there is no need of synchronization between the wafer and a photodetector, the equipment can be conveniently operated. Especially, since useful information for the following wafer polishing process can be instantly obtained, rapidly transmitted and applied, even during a multi-step polishing process, time consumed in measuring layer thickness variation can be remarkably reduced.

In addition, it is possible to simplify the equipment and improve spatial arrangement and space utilization by implementing a predetermined structure in the conventional loading device, without installing of a separate wafer station for measuring the wafer layer thickness.

While the invention has been shown and described with reference to certain exemplary embodiments thereof, it will be understood by those skilled in the art that various changes in form and details may be made therein without departing from the spirit and scope of the invention as defined by the appended claims.

The invention claimed is:

1. A loading device of chemical mechanical polishing (CMP) equipment for processing semiconductor wafers, including:

a loading cup having a cup-like bath;

a cup plate installed in the bath;

a loading plate supported on the cup plate for absorbing shock and seating a semiconductor wafer;

a driving device and a driving shaft horizontally pivoting and vertically moving the loading cup between a platen of a polishing apparatus and a spindle;

an arm connecting the loading cup and the driving shaft, wherein at least one through hole is located at one or more mutually corresponding positions of the bath, the cup plate, and the loading plate of the loading cup;

at least one probe assembly for optically detecting a polished thickness at a polished point on the wafer in each through hole at the corresponding position of the loading cup;

an optical thickness detection device for applying light onto a layer on the semiconductor wafer, detecting reflected wavelengths, and detecting layer thickness of the semiconductor wafer from a change in a physical quantity extracted from a light interference signal resulting from the reflected wavelengths detected, the optical thickness detection device being located at one side of the driving device; and an optical fiber cable connecting each of the probe assemblies and the thickness detection device, disposed in the arm.

2. The loading device according to claim 1, wherein the polishing apparatus includes at least one pair of a polishing carrier and a platen for multi-step polishing of the layer on the semiconductor wafer, and for extracting information on the layer thickness from the semiconductor wafer disposed between the polishing carrier and the platen, after a polishing process is performed on a previously input wafer, and just before a polishing is performed on a subsequently input wafer, or before a subsequent polishing process is performed on the same previously input wafer.

3. The loading device according to claim 1, wherein the probe assembly includes a further optical fiber cable connected with a light source of the thickness detection device, a ferrule surrounding the further optical fiber cable, a light-transmission protective cap as a transmission window coupled to tips of the further optical fiber cable and the ferrule and inserted into the loading plate at the through hole, and a probe tip positioner for positioning tips of the further optical fiber cable and the light-transmission protective cap in a vertical direction.

4. The loading device according to claim 3, wherein the probe tip positioner includes an insert ring that is closely fixed to an outer surface of the ferrule near a back surface of the loading plate, a compressible resilient body that is interposed and supported at opposite ends between a step in the through hole of the loading plate and a top surface of the insert ring and continuously exerts a resilient force, simultaneously lowering the insert ring together with the optical fiber cable and the ferrule, and a positioning threaded pipe including a through hole for receiving the optical fiber cable and the ferrule without contact, having a male thread on an outer surface and received in a through hole of the cup plate for engaging a female thread in the through hole of the cup plate, contacting and upwardly supporting a back surface of the insert ring at a top end.

5. The loading device according to claim 3, wherein the polishing apparatus includes at least one pair of a polishing carrier and a platen for multi-step polishing of the layer on the semiconductor wafer, and for extracting information on the layer thickness from the semiconductor wafer disposed between the polishing carrier and the platen, after a polishing process is performed on a previously input wafer, and just before a polishing is performed on a subsequently input wafer, or before a subsequent polishing process is performed on the same previously input wafer.

6. The loading device according to claim 1, including a light-transmission protective layer on a top surface of the loading plate of the loading cup, protecting a probe from contamination during a polishing process and precisely detecting reflected light.

7. The loading device according to claim 6, wherein the polishing apparatus includes at least one pair of a polishing carrier and a platen for multi-step polishing of the layer on the semiconductor wafer, and for extracting information on the layer thickness from the semiconductor wafer disposed between the polishing carrier and the platen, after a polishing process is performed on a previously input wafer, and just before a polishing is performed on a subsequently input wafer, or before a subsequent polishing process is performed on the same previously input wafer.

* * * * *